United States Patent [19]

Davis, III

[11] Patent Number: 5,058,233

[45] Date of Patent: Oct. 22, 1991

[54] CLEANING DEVICE

[76] Inventor: Charles F. Davis, III, 2325 Seashell Rd., No. 305, Virginia Beach, Va. 23451

[21] Appl. No.: 584,142

[22] Filed: Sep. 18, 1990

Related U.S. Application Data

[63] Continuation-in-part of Ser. No. 407,957, Sep. 15, 1989, Pat. No. 4,970,750.

[51] Int. Cl.[5] ..... A47L 13/16

[52] U.S. Cl. ..... 15/244.1; 15/228; 300/21

[58] Field of Search ..... 15/244.1-244.4, 15/119 A, 228, 245, 115, 118; 300/21

[56] References Cited

U.S. PATENT DOCUMENTS

| | | | |
|---|---|---|---|
| 1,509,381 | 9/1924 | Townsend . | |
| 1,586,337 | 5/1926 | Stockwell . | |
| 2,070,123 | 2/1937 | Grant | 15/244 |
| 2,138,712 | 11/1938 | Saffert | 91/68 |
| 2,790,193 | 4/1957 | Wilding | 15/210 |
| 3,090,985 | 5/1963 | Baum | 15/244 |
| 3,214,779 | 11/1965 | Wheeler | 15/244 |
| 3,225,375 | 12/1965 | Atkinson et al. | 15/210 |
| 3,262,145 | 7/1966 | Carlson | 15/244 |
| 3,274,635 | 9/1966 | Myers | 15/244 |
| 3,353,203 | 11/1967 | Ginter | 15/244 |
| 3,491,397 | 1/1970 | Hesener | 15/118 |
| 3,785,000 | 1/1974 | Zacha et al. | 15/244 R |
| 4,317,250 | 3/1982 | Shutts | 15/244 |

*Primary Examiner*—Edward L. Roberts

*Attorney, Agent, or Firm*—Griffin Branigan & Butler

[57] ABSTRACT

A cleaning device (10) for bath tubs, shower enclosures, swimming pools, and the like, comprises a more rigid support block (12) attached in a cavity (40) formed in a sponge block (14). A support-block bottom surface (22) is substantially flat and is substantially parallel to a substantially flat sponge bottom outer surface (36). A support-block sidewall surface (24) extends upwardly from said support block bottom surface when said support block bottom surface is horizontal but includes an inwardly beveled transition portion (30). A bottom edge area (38) of a sponge block outer surface (32) is spaced substantially further from the support block than other portions of the sponge outer surface. There is a dimple (50) in the sponge bottom outer surface positioned below the cavity. A maximum spacing of the sponge-block outer surface from a support-block outer surface (20) is in a range of from one-half inch to two inches, with the bottom edge area 38normally being one and one half inches therefrom and most of the remainder of the sponge block outer surface being around one inch therefrom. The support block can be molded in the cavity as well as held therein by protrusions on the outer surface of the support block.

11 Claims, 12 Drawing Sheets

CLEANING DEVICE

This application is a continuation-in-part application of application Ser. No. 07/407,957 filed Sept. 15, 1989, now U.S. Pat. No. 4,970,750.

BACKGROUND OF THE INVENTION

This invention relates broadly to the art of cleaning devices which comprise sponges or sponge-like materials on ends of elongated handles and methods of constructing the same.

Over the years, there have been a number of cleaning devices suggested comprising elongated handles having sponges, or sponge-like material, on the ends thereof. For example, Hesener U.S. Pat. No. 3,491,397 describes a cleaning device in which a support core is inserted into a hole in a sponge-like block and is attached thereto. The support core has an elongated handle attached thereto for manipulating the block. Although the Hesener cleaning device has some advantages, a major difficulty with it is that various support surfaces described therein do not provide adequate back-up support for bottom, and sidewall outer surfaces of the sponge-like block for applying required cleaning pressures without damaging the sponge-like block. Thus, it is an object of this invention to provide a cleaning device wherein a sponge-like block is attached to a support block in which sidewall and bottom outer surfaces of the sponge-like block are adequately supported by the support block to apply needed cleaning pressures without unduly damaging the sponge-like block.

A particular difficulty with the cleaning device of Hesener is that some of the relative dimensions of the support core shown therein are unduly small and sharp which causes cutting of the sponge when the sponge is being applied for cleaning in certain directions. Thus, it is an object of this invention to provide a cleaning device wherein a sponge-like block is not unduly cut or otherwise unduly damaged by a support block when the cleaning device is being used for cleaning.

Another sponge mop is disclosed in Myers U.S. Pat. No. 3,274,635. The sponge mop of Myers has outer surfaces which are provided with very little inner support. Such inadequately-supported sponge surfaces inhibit uniform cleaning and lead to ununiform strains and stresses placed on a sponge. These ununiform strains and stresses create quick deterioration of the sponge, which, of course, is undesirable. Thus, it is an object of this invention to provide a cleaning device wherein a sponge block is adequately supported by a support block so as not to create undue wear on the sponge block when it is being used for cleaning.

Yet another difficulty with many prior art devices is illustrated in Baum U.S. Pat. Nos. 3,090,985 and 1,509,381 to Townsend. Sponges in the devices of these patents are wrapped on unusually shaped internal supports and are so thin that they can only be used for cleaning specifically shaped objects. They do not allow one to easily clean in corners and grooves. Thus, it is an object of this invention to provide a cleaning device having a sponge block and support block which can be used for cleaning objects of most shapes and, in particular, can be used for cleaning in sharp corners and in grooves.

A related problem is that some prior art sponge devices will not allow easy transition from cleaning a horizontal surface to cleaning a vertical surface or from cleaning one vertical surface to cleaning a perpendicular vertical surface without causing undue stress on a sponge and providing uneven cleaning. Therefore, it is an object of this invention to not only provide a cleaning device in which a sponge block is adequately supported by a support block for cleaning both horizontal and vertical surfaces, but which also allows a smooth transition from cleaning horizontal to vertical surfaces, and/or from cleaning one vertical surface to cleaning another vertical surface at a corner, without causing undue stresses on the sponge block while providing uniform cleaning.

SUMMARY OF THE INVENTION

According to principles of this invention, a cleaning device comprising a more rigid support block attached in a cavity of a sponge block includes a support-block bottom surface and a sponge bottom outer surface which are substantially flat and approximately parallel to one another and a support-block sidewall surface having a transition portion adjacent the support-block bottom surface which is beveled inwardly toward the support-block bottom surface. A bottom edge area of a sponge outer surface is spaced substantially further from an outer surface of the support block than other portions of the sponge outer surface, with the bottom edge area normally being one and one half inches therefrom and most of the remainder of the sponge block outer surface being around one inch therefrom. A size and shape of a sponge-block cavity surface is close to a size and shape of support-block bottom and sidewall surfaces. The sponge block bottom outer surface has a dimple therein adjacent the cavity which is created by forming the cavity bottom surface to be concave while forming the support-block bottom surface to be flat. The support block can be molded in the cavity or held therein by protrusions on the support block.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
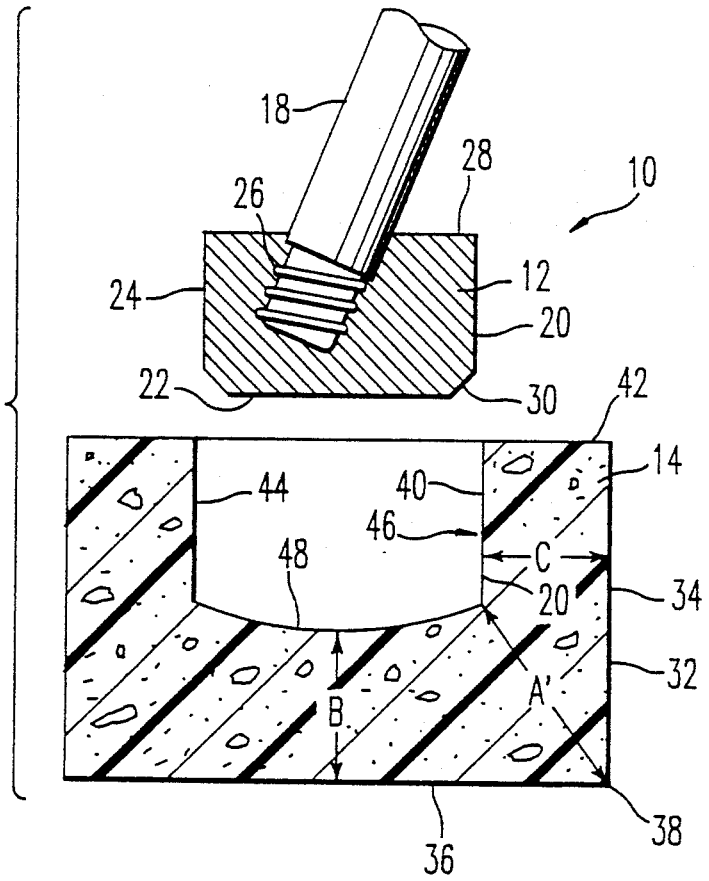
FIG. 1 is an exploded, segmented, partially-sectional, side view of a first embodiment cleaning device of this invention.
Figure 2:
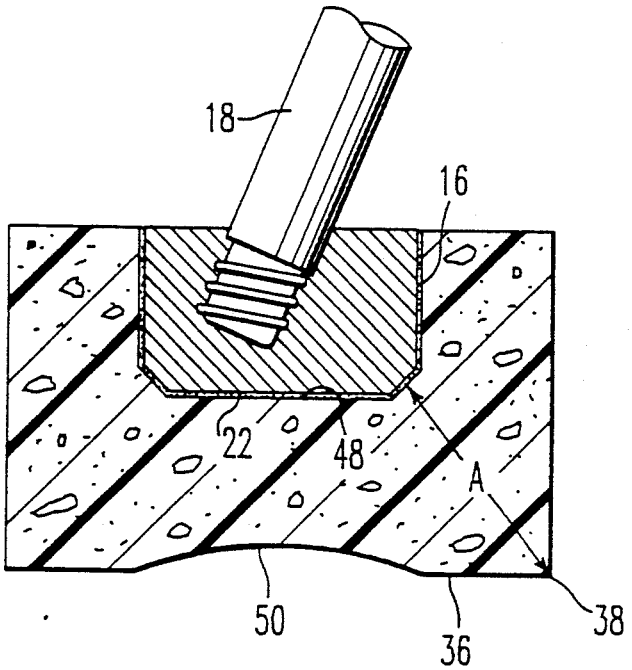
FIG. 2 is a segmented, partially-sectional, side view of the first embodiment cleaning device of FIG. 1 once it is assembled.

Referring now to the drawings, a first-embodiment cleaning device 10 shown in FIGS. 1 and 2 comprises a rigid support block 12, a sponge block 14, an adhesive 16 and an elongated handle 18.

Figure 2A:
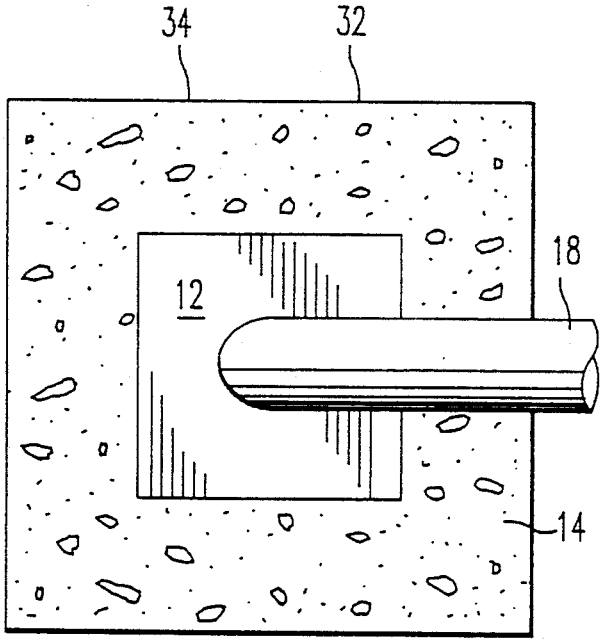
FIG. 2A is a segmented, top view of the first embodiment cleaning device of FIGS. 1 and 2.

The rigid support block 12 defines a support-block outer surface 20 including a support-block bottom surface 22 and a support-block sidewall surface 24. The rigid support block 12 is rectangular in plan view, as can be seen in FIG. 2A, being basically a solid member but having a female threaded hole 26 in a top surface 28 thereof for receiving the elongated handle 18. The solid rigid support block can be constructed of a substantially solid piece of wood or can be molded of a resinous plastic. If the rigid support block 12 is molded, the support-block sidewall surface 24 will be tapered inwardly toward the support-block bottom and/or top surface a draft angle of around 1° for allowing the rigid support block 12 to be easily removed from a mold. The support-block bottom surface 22 is normally substantially solid and substantially flat and the support-block sidewall surface 24 is also substantially solid and in this embodiment is approximately square to the support-block bottom surface 22. However, the support-block sidewall surface 24 also includes a transition portion 30 which is beveled inwardly toward the support-block bottom surface.

The sponge block 14 defines a sponge outer surface 32 including a sponge sidewall outer surface 34 and a sponge bottom outer surface 36. The sponge sidewall outer surface 34 comprises generally four surfaces arranged in a square, as can be seen in FIG. 2A, with each surface being rectangular and directed outwardly. It should be noted that the sponge sidewall outer surface 34 is substantially perpendicular, or square, to the sponge bottom outer surface 36 and that these two surfaces intersect at a bottom edge area 38. The sponge block 14 is constructed of a sponge material having very low water and detergent absorption characteristics. It has been found that the sponge block 14 functions best when it is reticulated and its pores per linear inch fall in a range of from 50–80, preferably around 50. This is a type of foam that is normally used for filters.

The sponge block further defines a cavity 40 formed in a top surface 42 thereof which extends a substantial distance into the sponge block. The cavity has a cavity surface 44 with a cavity sidewall surface 46 and a cavity bottom surface 48. The cavity surface 44 has a size and shape that is close to the size and shape of the support-block outer surface 20 so that it snugly receives the rigid support block 12, however, it should be noted that the cavity bottom surface 48 is concave before the rigid support block 12 is adhered to the sponge block 14 by the adhesive 16 while the support-block bottom surface 22 is flat. Also, the cavity sidewall surface 46 does not include a bevel corresponding to the transition portion 30 of the support-block sidewall surface 24.

The support-block bottom surface 22 and the sponge bottom outer surface 36 are both substantially flat and once the rigid support block 12 is adhered in the cavity 40 of the sponge block 14 these two surfaces are substantially parallel with one another. However, it should be noted that because of the concave cavity bottom surface 48, once these two members are adhered to one another, a dimple 50 appears in the sponge bottom outer surface 36.

Thicknesses of walls of the sponge block 14, that is, distances from the sponge outer surface 32 to the cavity surface 44 is between one-half inch and two inches. If this wall is less than one-half inch, the first-embodiment cleaning device 10 does not work well for cleaning grooves and corners; in fact, the first-embodiment cleaning device works best if these walls are at least one inch thick. If the wall thicknesses exceed two inches, however, too much strain and stress is applied to the sponge block 14 during use of the first-embodiment cleaning device 10 so that the sponge block 14 deteriorates too quickly. Also, if the wall thickness exceeds two inches, an insufficient amount of internal support is provided to the sponge outer surface 32 for proper cleaning. It should be noted that the bottom edge area 38 of the sponge outer surface 32 is spaced a distance A from the support-block outer surface 20 which is substantially greater than distances other portions of said sponge outer surface are spaced from said support block outer surface 20. This distance A is slightly greater than a distance A' of the bottom edge area 38 from the cavity surface 44 when the support block 12 is not glued into the sponge block 14. This distance A, as is mentioned above, cannot be greater than two inches, and is usually between one and one half inches and two inches. Thus, distances B and C, distances the sponge bottom outer surfaces 36 and the sponge sidewall outer surface 34 are spaced from the support-block outer surface 20, are substantially less than two inches, usually being about one inch or between one half inch and one and one half inches.

Figure 3:
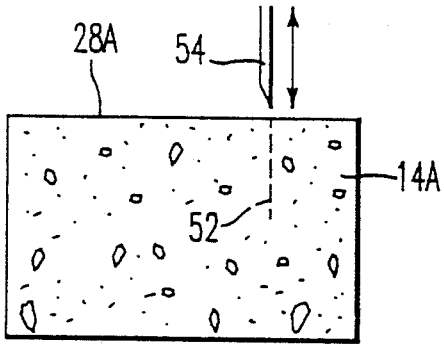
FIG. 3 is a side schematic view showing a step in a process for manufacturing the first embodiment cleaning device of this invention depicted in FIGS. 1 and 2.
Figure 4:
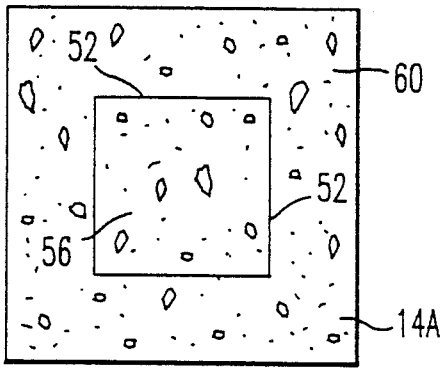
FIG. 4 is a top view of the sponge block of FIG. 3 during a step in the process for manufacturing the first embodiment cleaning device of FIGS. 1 and 2.
Figure 5:
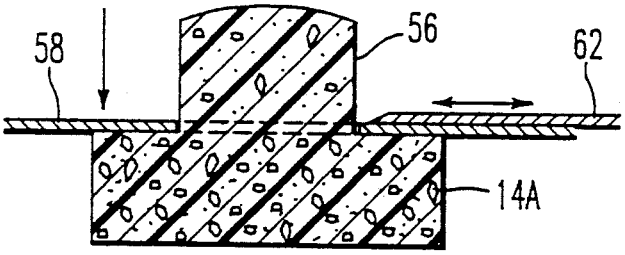
FIG. 5 is a side view of the sponge block of FIGS. 3 and 4 and further including a holding tool and a cutting tool during another step in the process of manufacturing the first embodiment cleaning device of FIGS. 1 and 2.
Figure 6:
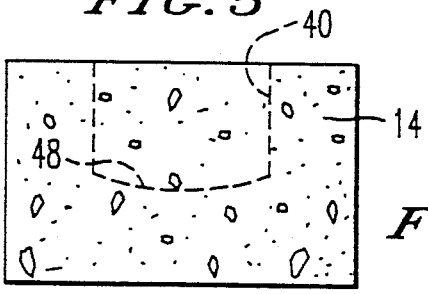
FIG. 6 is a side view of the sponge block of FIGS. 3–5 during another step in the process of manufacturing the first embodiment cleaning device of FIGS. 1 and 2.

Looking now at a method of constructing the first-embodiment cleaning device of FIGS. 1–2B, a rectangular sponge 14A has partial cuts 52 made into a top surface 28A with a straight flat blade 54. As can be seen in FIG. 3, these partial cuts 52 extend approximately to the cavity bottom surface 48. As can be seen in FIG. 4, sufficient partial cuts 52 are made to form a square cutout portion 56 of the rectangular sponge 14A. After the partial cuts have been made to define the square cutout portion 56, a compressing tool 58, as is shown in FIG. 5, having an opening (not shown) therein which is about the size of the cutout portion 56, is pressed downwardly, compressing a sidewall portion 60 of the sponge block 14 but leaving the cutout portion 56 uncompressed. A cutting tool 62 is then slid across a top surface of the compressing tool 58, to thereby cut the cutout portion 56 away from the rest of the rectangular sponge 14A. The compressing tool 58 is then removed from the sidewall portion 60, allowing the sidewall portion 60 to expand, thereby creating the sponge block 14 with its cavity 40. It should be noted that the cavity bottom surface 48 when produced in this manner, is automatically concaved, as depicted in FIGS. 1 and 6.

Figure 7:
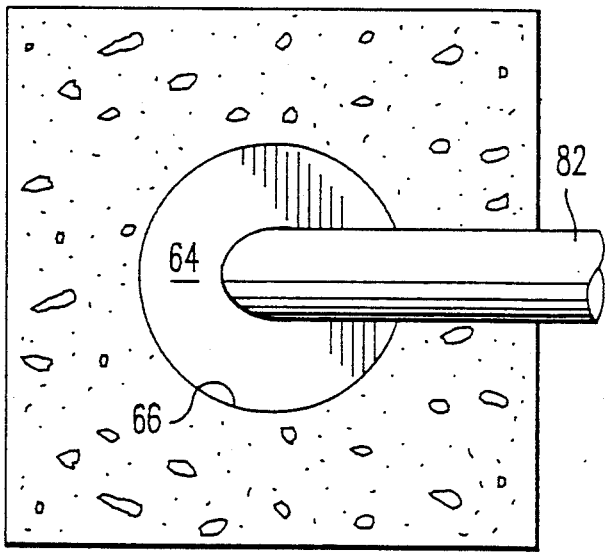
FIG. 7 depicts a segmented, top view of a second-embodiment cleaning device of this invention.
Figure 8:
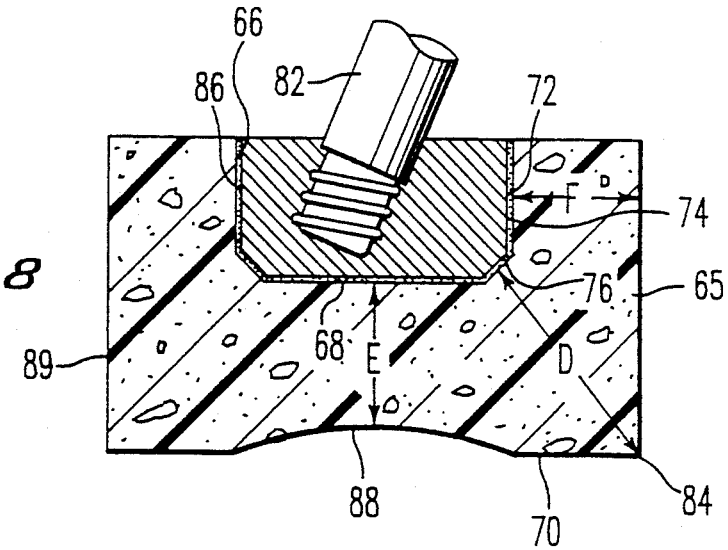
FIG. 8 is a segmented, side, partially-sectional, view of the second-embodiment cleaning device of FIG. 7.
Figure 9:
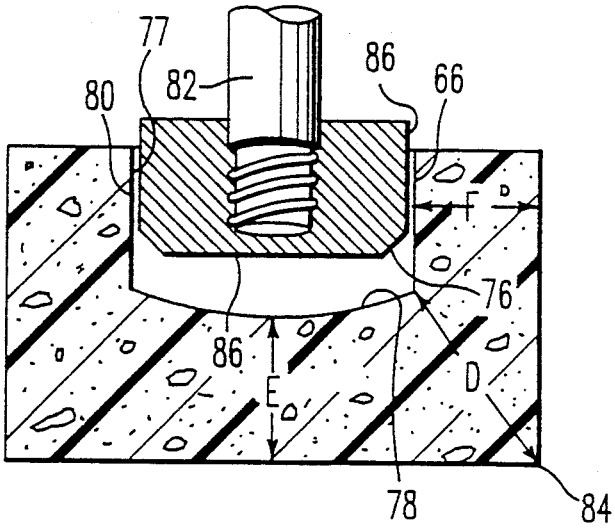
FIG. 9 is an exploded, segmented, front, partially-sectional, view of the second-embodiment cleaning device of FIGS. 7 and 8 during a step in a process of manufacturing the second-embodiment cleaning device.

The second-embodiment cleaning device of FIGS. 7–9 is basically the same as the cleaning device of FIGS. 1–3 with the difference that a rigid support block 64 and a cavity 66 for receiving the rigid support block 64 are round when viewed from above. However, it should be noted that the rigid support block 64 has a substantially flat support-block bottom surface 68 which is substantially parallel to a sponge bottom outer surface 70 and which is approximately square to a portion 72 of a support-block sidewall surface 74. Further, the support-block sidewall surface 74 includes a transition portion 76 adjacent the support-block bottom surface which is beveled inwardly toward the support-block bottom surface. Further, the size and shape of the support-block bottom and sidewall surfaces are close to the size and shape of a cavity surface 77 with an adhesive adhering cavity bottom and sidewall surfaces to the support block bottom and sidewall surfaces 68 and 74. An elongated handle 82 is attached to the rigid support block 64. Finally, as in the FIGS. 1–3 embodiment, a bottom edge area 84 of the sponge block 65 is spaced a distance from a support-block outer surface 86 which is greater than distances other portions of said sponge outer surface are spaced from said support-block outer surface. Again, the distance D is less than two inches usually being between one and one half inches and two inches, while the distances E and F are greater than one-half inch but less than one and one half inches, usually being around one inch. In the second-embodiment cleaning device of FIGS. 7–9, the cavity 66 is made with a boring machine rather than in the manner depicted in FIGS. 3–6, with a bit, having many cutting blades thereon, automatically preparing the concave cavity bottom surface 78. Again, this concave surface 78 produces a recessed dimple 88 in the sponge bottom outer surface 70 once the cleaning device is assembled as depicted in FIG. 8.

It should be noted that in each of the first-embodiment of FIGS. 1–3 and the second-embodiment of FIGS. 7–9 the sponge cavity, 40 in the first embodiment and 66 in the second embodiment, does not have a transition portion corresponding to the support-block transition portion, 30 of the first embodiment and 76 of the second embodiment, but rather the sponge cavity sidewall surface, 46 of the first embodiment and 80 of the second embodiment, are substantially square with the cavity bottom surface, 48 of the first embodiment and 78 of the second embodiment. However, once the rigid support block is assembled with the sponge block of each of these embodiments, the sponge block will expand to conform to this beveled transition area without substantially changing the shape of the sponge outer surface, 32 of the first embodiment and 89 of the second embodiment.

Figure 10:
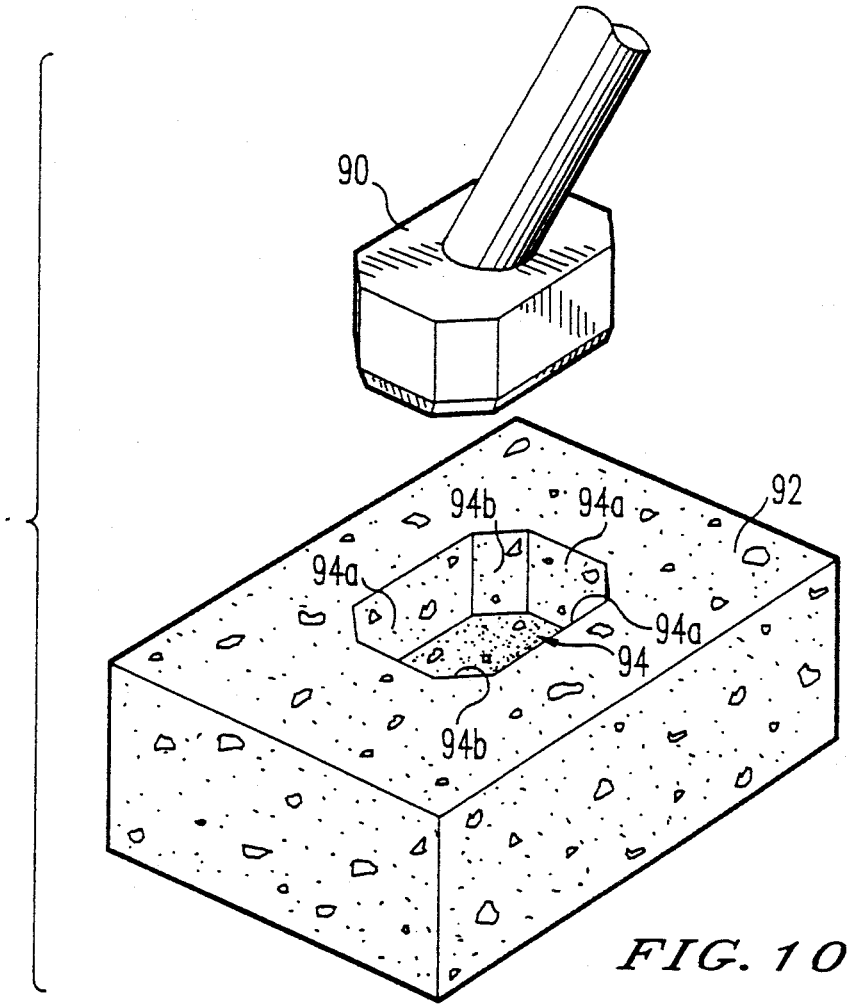
FIG. 10 is an exploded, segmented, isometric view of a third-embodiment cleaning device of this invention.
Figure 11:
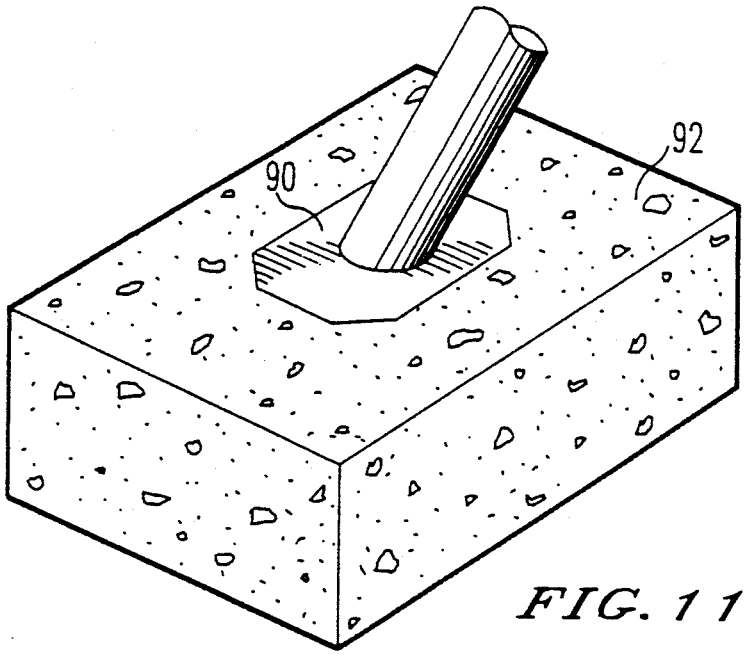
FIG. 11 is an isometric, segmented, view of the third-embodiment cleaning device of FIG. 10 when fully assembled.

In the third embodiment of FIGS. 10 and 11, a rigid support block 90 and a sponge block 92 have the same basic relationship one to the other as in the first and second embodiments with the exception that when viewed from above, the rigid support block 90 and a cavity 94 of the sponge block 92 is not square nor round but rather an eight sided polygon. Long, square, sides **94*a* of the eight-sided polygon are around 1⅛ inches long while short, corner, sides 94*b*** are around 13/16 inch long.

Figure 12:
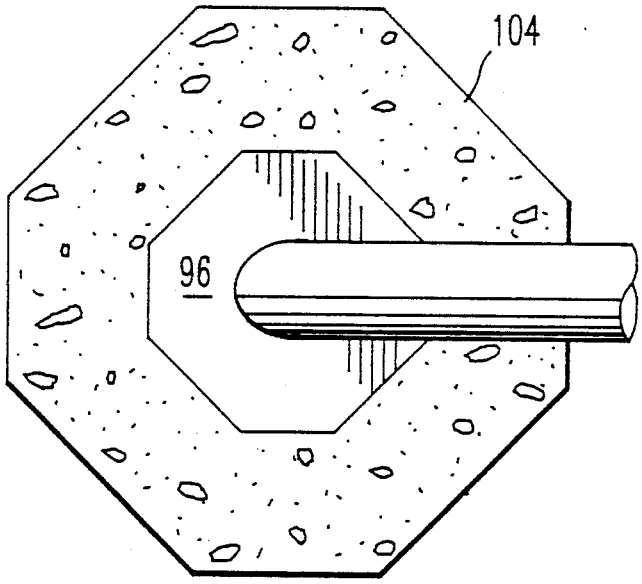
FIG. 12 is a segmented, top plan view of a fourth-embodiment cleaning device of this invention.
Figure 13:
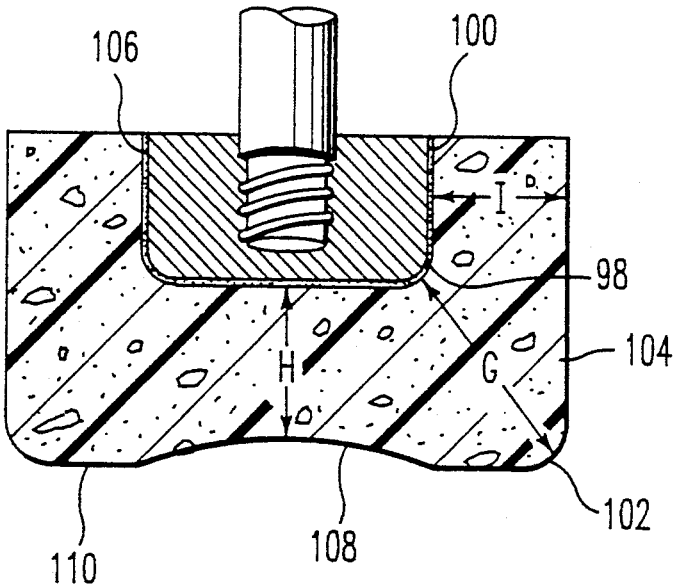
FIGS. 13 and 14 are respectively front and side, segmented, partially-sectional, views of the fourth-embodiment cleaning device of FIG. 12.
Figure 14:
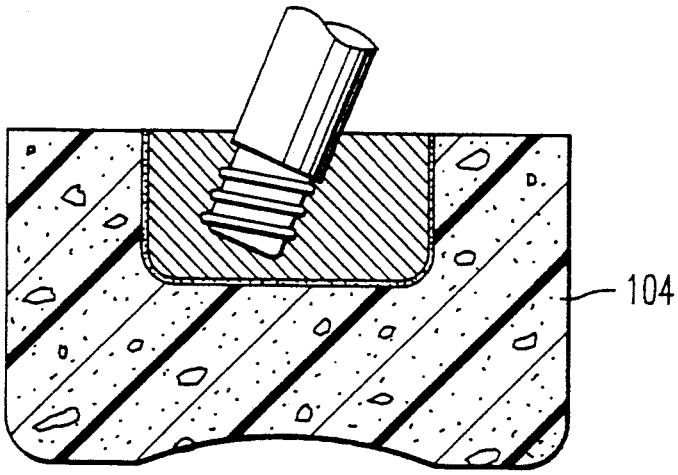

In the fourth embodiment of FIGS. 12–14, a rigid support block 96 has a octagon shape in top plan view. This fourth embodiment cleaning device also differs from the other embodiments heretofore described in that a transition portion 98 of a support-block sidewall surface 100 is a rounded progressive bevel rather than being a straight bevel as previously described. However, as in the other embodiments, a bottom edge area 102 of a sponge block 104 is spaced a distance G (less than two inches and usually being between one and one half inches and two inches) from a support block outer surface 106 which is greater than distances H and I (greater than ½ inch and less than one and one half inches, usually being around one inch) of other portions from said support block outer surface. Again, an indented dimple 108 is in a sponge bottom outer surface 110 below a sponge cavity.

Figure 15:
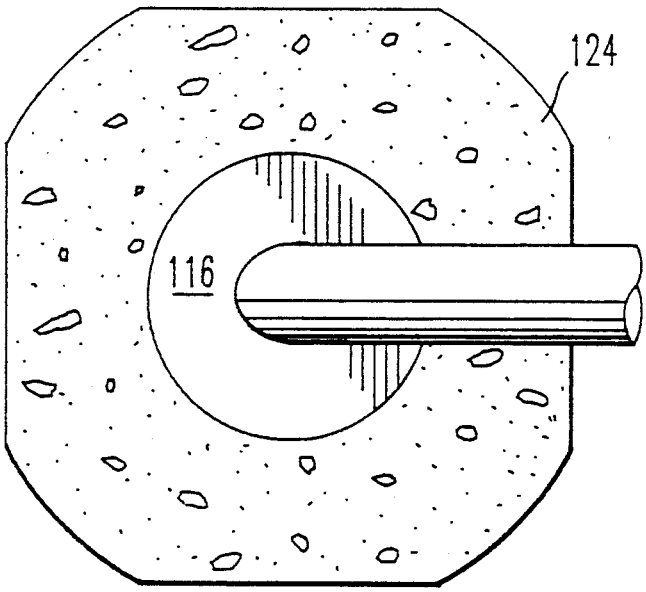
FIG. 15 is a segmented, top plan view of a fifth-embodiment cleaning device of this invention.
Figure 16:
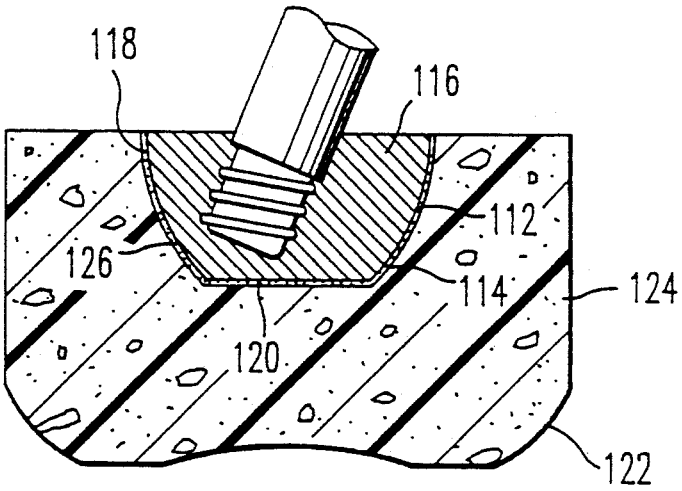
FIGS. 16 and 17 are respectively side and front segmented, partially-sectional, views of the fifth-embodiment cleaning device of FIG. 15.
Figure 17:
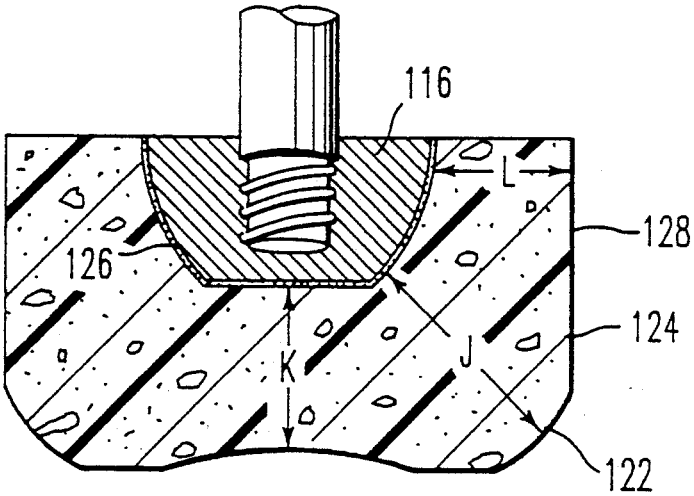

The fifth embodiment of FIGS. 15–17 differs from the other embodiments in that a rounded-bevel transition portion 112 of a support-block sidewall surface 114 extends almost the entire height of a rigid support block 116, with only a rim portion 118 of the support-block sidewall surface 114 being approximately square to a support-block bottom surface 120. Yet another difference between the fifth embodiment of FIGS. 15–17 and most embodiments already described is that the rigid support block 116, when viewed in plan from above has a round shape. Still another difference between the fifth embodiment of FIGS. 15 and 17 and the previously described embodiments is that a bottom edge area 122 of a sponge block 124 is blunted, or rounded. However, as in the other embodiments, the bottom edge area 122 is spaced a distance J (less than 2 inches and usually being between one and one half inches and two inches)

from a support block outer surface 126 which is greater than distances K and L (greater than ½ inch and less than one and one half inches, usually being around one inch) other portions of a sponge outer surface 128 are spaced from the support-block outer surface 126. In this embodiment, since the sponge-block bottom edge area 122 is blunted to get within the two inch maximum wall thickness dimension, the distances J and K can be somewhat greater than in the other embodiments.

Figure 18:
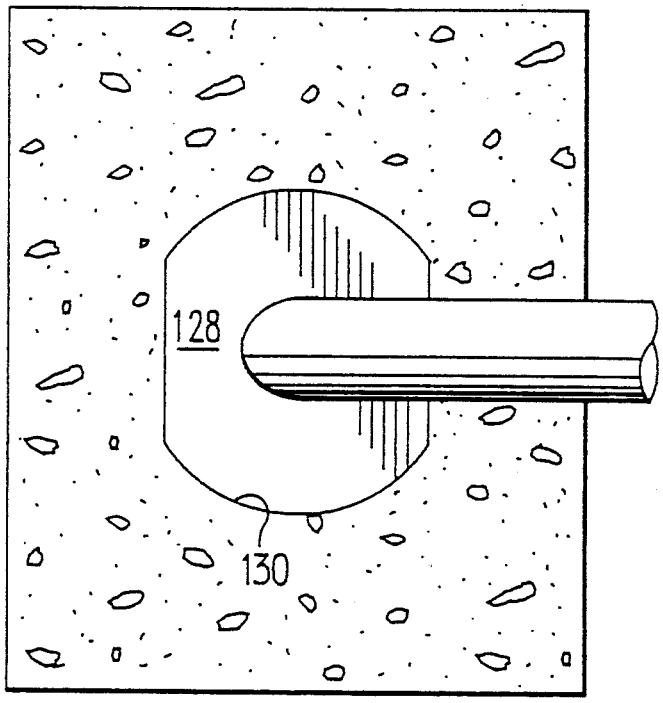
FIG. 18 is a segmented, top plan view of a sixth-embodiment cleaning device of this invention.

The sixth embodiment of FIG. 18 is basically the same as the embodiments already described with the exception that a rigid support block 128 and its corresponding sponge-block cavity 130 have a truncated circular shape when seen from a plan top view. It should be understood that for this embodiment the same basic structural relationships as for the previously-described embodiments holds, with one being able to substitute various structural features, such as rounded or straight beveled support-block transition portions.

Figure 19:
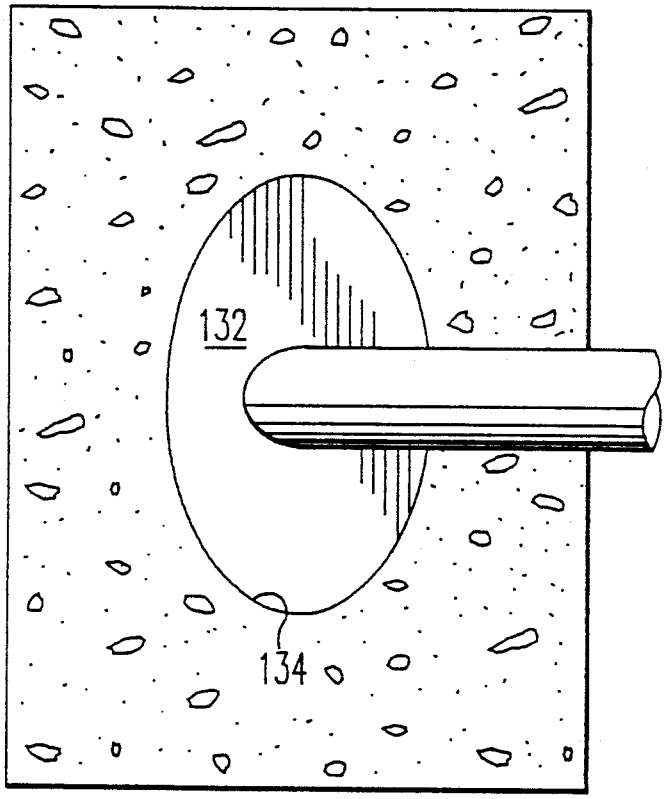
FIG. 19 is a segmented, top plan view of a seventh-embodiment cleaning device of this invention.

In the seventh embodiment of FIG. 19, a rigid support block 132 and a corresponding sponge-block cavity 134 have an oval shape when seen from a top plan view. Otherwise, the relationships described for the other embodiments exist for the seventh embodiment of FIG. 19.

Figure 20:
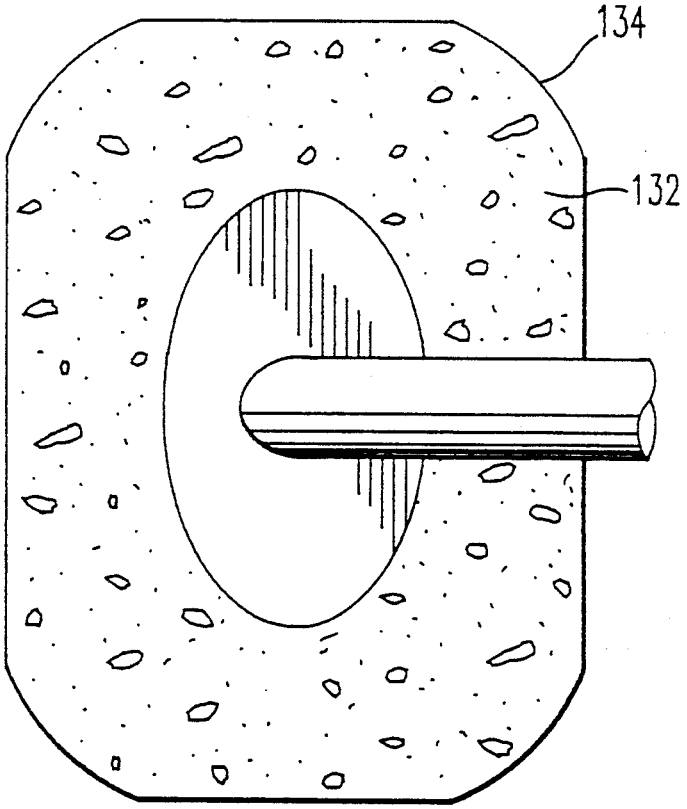
FIG. 20 is a segmented, top plan view of an eighth-embodiment cleaning device of this invention.

The eighth embodiment of FIG. 20 is similar to that of the seventh embodiment of FIG. 19 with the exception that corner areas 136 of a sponge block 138, as seen from a top plan view, are blunted, or rounded.

Figure 21:
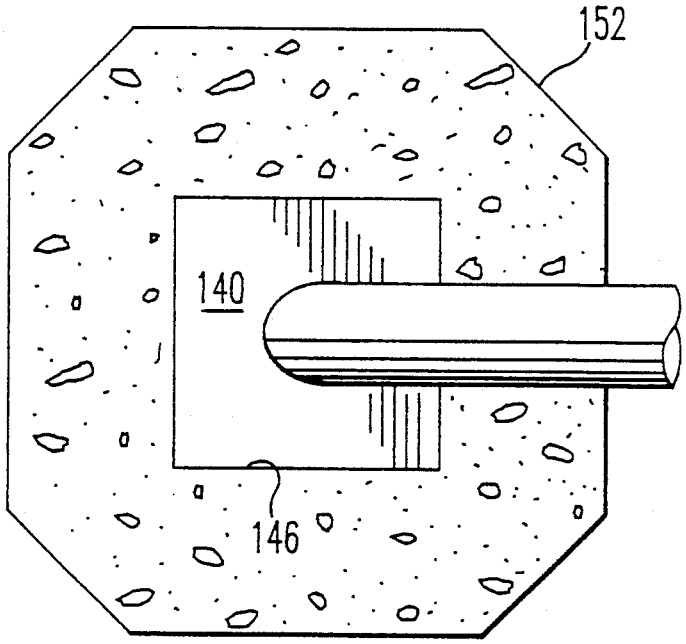
FIG. 21 is a segmented, top plan view of a ninth-embodiment cleaning device of this invention.
Figure 22:
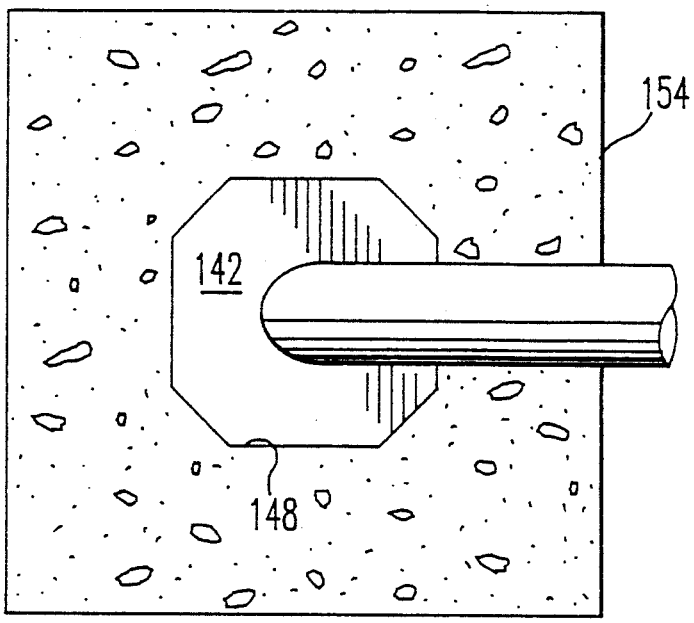
FIG. 22 is a segmented, top plan view of a tenth-embodiment cleaning device of this invention.
Figure 23:
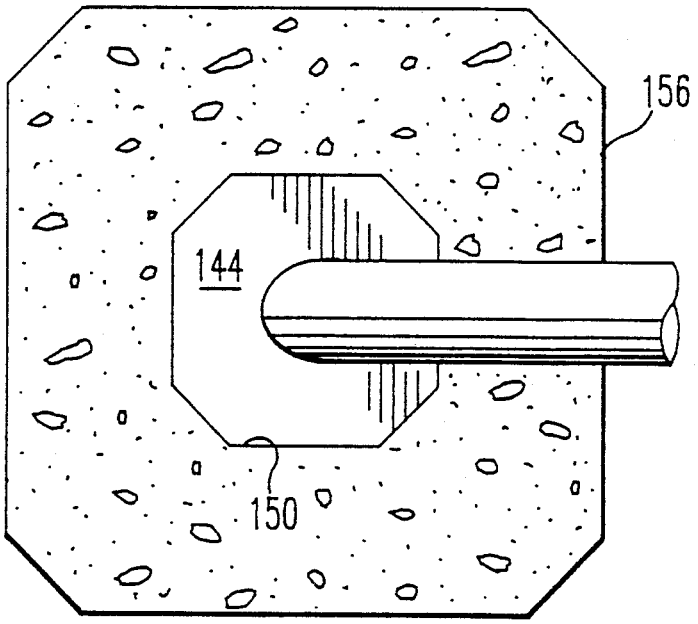
FIG. 23 is a segmented, top plan view of a eleventh-embodiment cleaning device of this invention.

The ninth, tenth and eleventh embodiments of FIGS. 21, 22 and 23 show that additional plan view arrangements of rigid support blocks 140, 142, and 144 and their corresponding sponge-block cavities 146, 148 and 150 are possible as are different sponge block outer surfaces 152, 154 and 156. The same structural relationships previously described are also true for these embodiments, with one being able to mix and substitute the various structural features previously described herein.

Figure 24:
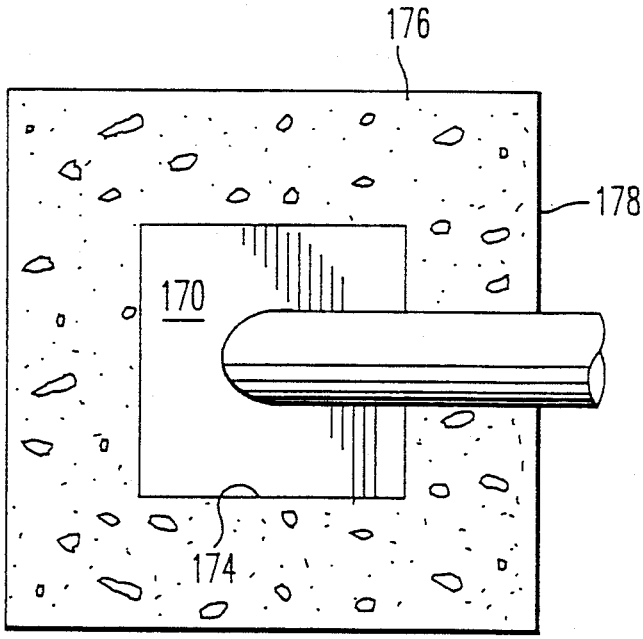
FIG. 24 is a top plan view of a twelfth embodiment cleaning device of this invention.
Figure 25:
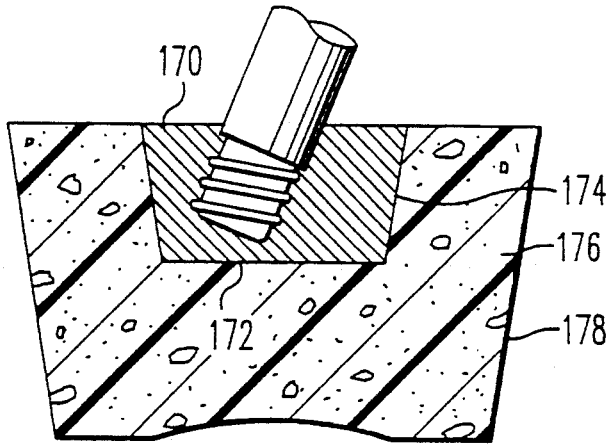
FIG. 25 is a side sectional view of the twelfth embodiment cleaning device of FIG. 24.
Figure 26:
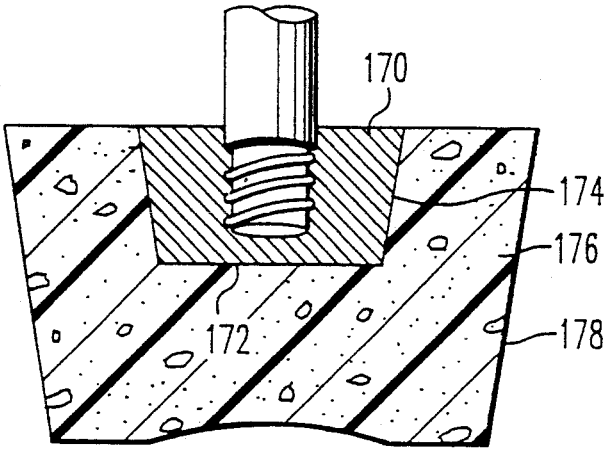
FIG. 26 is a front section view of the twelfth embodiment cleaning device of FIGS. 24 and 25.

FIGS. 24, 25 and 26 depict a twelfth embodiment of this invention in which a support block 170 has a substantially flat support-block bottom surface 172 and a support-block sidewall surface 174 extending upwardly from said support-block bottom surface 172 when said support-block bottom surface 172 is horizontal, but in which case the entire support-block sidewall surface 174 forms a substantial transition portion adjacent said support-block bottom surface 172. That is, the entire support-block sidewall surface 174 is substantially beveled inwardly towards said support-block bottom surface 172.

As can be seen in FIGS. 24–26, a sponge block 176 has a sponge outer surface including a sponge sidewall outer surface 178 which is approximately parallel to the support-block sidewall surface 174 and a sponge-bottom outer surface which is approximately parallel to the support-block bottom surface 172. Again, these two surfaces intersect at a bottom edge area which is spaced a distance from the support-block outer surface which is greater than distances other portions of the sponge outer surface are spaced from the support block outer surface.

Figure 27:
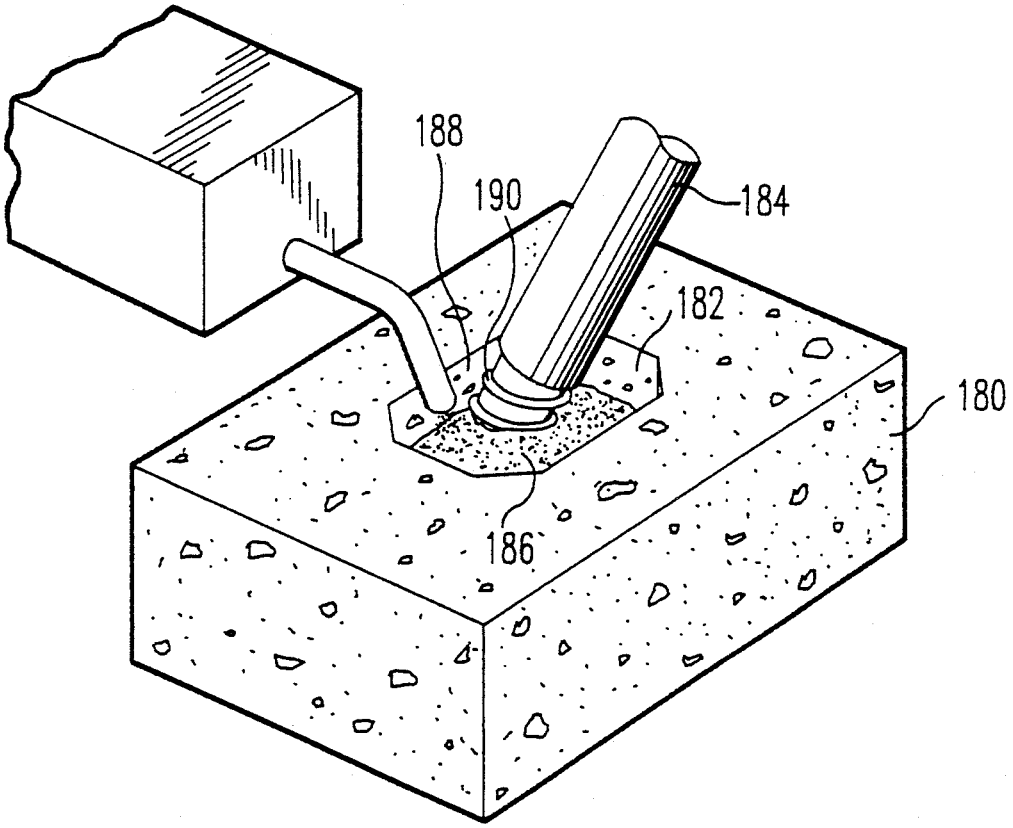
FIG. 27 is a schematic, isometric, segmented, view of a cleaning device of this invention being constructed by an alternate process.

FIG. 27 depicts an alternate method of constructing a cleaning device of this invention in which a sponge block 180 has a cavity 182 cut therein, an elongated handle 184 is placed and held in the cavity 182 and a fluid resinous plastic 186 is then poured into the cavity. The resinous plastic 186 is then hardened to adhere to a cavity surface 188 and threads, or grooves, 190 of the elongated handle 184. This hardened resinous plastic 186 thus forms a rigid support block for the sponge block 180. In this case, the resinous plastic 186 can be chosen to be softer than rigid support blocks of some of the other embodiments. Also, the resinous plastic 186, when fluid, must have a viscosity which will not unduly disperse into passages of the sponge block 180, but will migrate a small distance into some of the cells thereof for securely gripping the sponge block 180 when it is hardened. The elongated handle 184 can be made to screw into and out of the hardened rigid support block by placing a paraffin wax on the threads 190 prior to injecting the fluid resinous plastic 186.

In this method of manufacturing a support block, a sponge block cavity serves as a mold for the support block. The sponge block can be first placed in a fixture which supports its external walls and raises a center of its bottom surface to form a dimple.

Preferably, a cold mold potting compound is used to form the support block. One typical compound comprises a FREEMAN 53-008-9 polyester resin base manufactured by Freeman Chemical Corp., Post Office Box 996, Port Washington, Wis. 53074 along with activators, promoters and a catalyst to effect a cure (polymerization), a colorant, a thixatropic filler to adjust the viscosity, a flexibilizer to adjust rigidity, and microglass spheres to reduce weight.

Another cold mold compound which can be used in a reaction molding (RIM) process is Freeman, poly 5119 and ISO 5205, a colorant, a thixatropic filler, a flexibilizer, and microglass spheres.

The formulated compound can be introduced into the sponge block cavity by injection, pouring, or other casting method to a desired height, thereby covering a threaded portion of the handle. As the compound cures, it gels and takes on the form of the sponge block cavity and handle. It also generates heat and hardens, thereby forming a support block and encapsulating the handle. Such a support block molded in a 50 PPI reticulated sponge block should have a viscosity which allows it to penetrate pores within the sponge block cavity approximately one millimeter. The compound, in its liquid state, essentially surrounds skeletal wall structure of pores in the sponge block cavity, forming a mechanical bond between the thusly formed support block and sponge-block cavity surfaces when the block hardens. This bond is virtually impossible to break manually without tearing the sponge block.

As the compound cures within the sponge block cavity, the fixture should be vibrated to provide an even finish at a top surface of the support block casting.

It will be appreciated that this process eliminates a need for a separate mold to form a support block and handling an insertion of a support block within the sponge block cavity. This process also avoids the use of adhesives and steps necessary for the application thereof. Also eliminated is a step of screwing the handle into a support block.

Thus a benefit of the alternate method depicted in FIG. 27 of constructing a cleaning device of this invention is that it eliminates many steps. That is, with this process, one step of molding the rigid support block in the sponge cavity 182 forms the support block, adheres the support block to the sponge, and attaches the support block to the elongated handle 184. It will be understood by those of ordinary skill in the art that fixtures for supporting the sponge block 180 and the handle 184 are not included in FIG. 27. Also, it will be appreciated that such a fixture could raise a center of a bottom surface of the sponge block 180 to create a dimple in the bottom surface in the same manner as in the other embodiments of this invention. Also, the method of introducing appropriate chemicals and resinous plastics into the cavity 182 are depicted schematically, it being understood that these materials could be introduced thereinto by various means.

Figure 28:
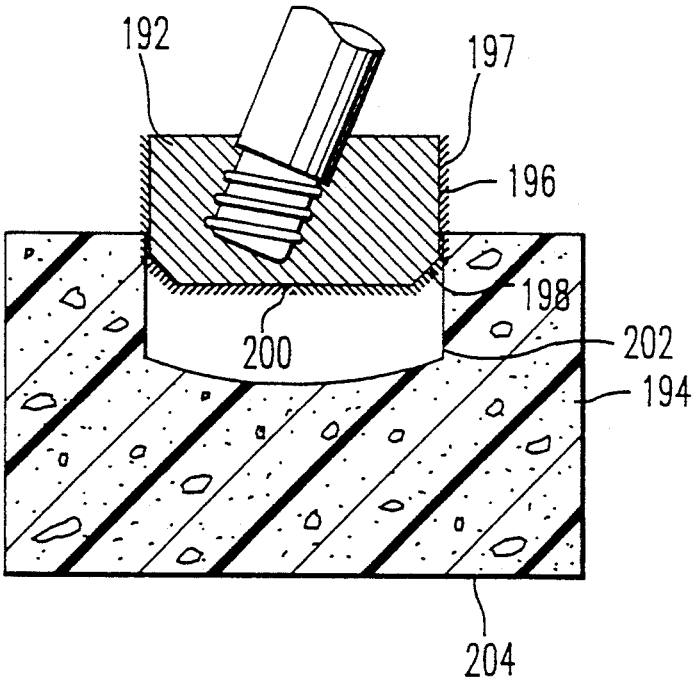
FIG. 28 is a side, sectional, exploded, view depicting a second alternate embodiment of a method of manufacturing a cleaning device of this invention.
Figure 29:
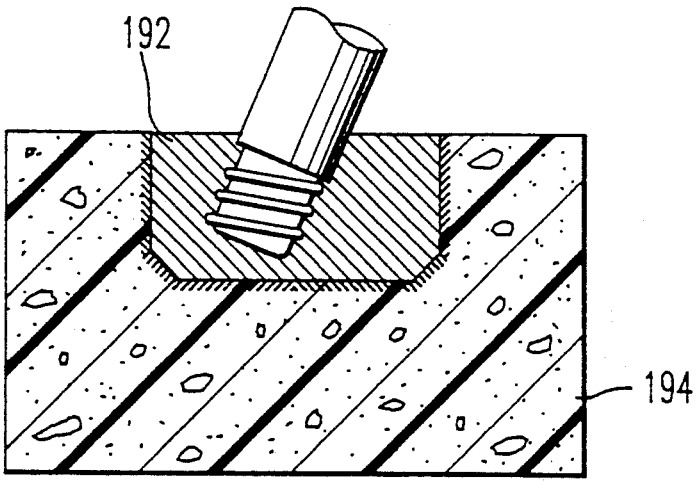
FIG. 29 is a side sectional view similar to FIG. 28, but not exploded.

FIGS. 28 and 29 depict a second alternate embodiment of manufacturing this invention in which a support block 192 is molded separately from a sponge block 194 but its outer surface includes numerous small dimples 196 (approximately one thousand per square inch, each one-half millimeter in diameter and one millimeter in depth in a preferred embodiment). The dimples are angled upwardly in FIG. 28 at approximately a 45 degree angle to a base of a mold in which the support block 192 is molded. The mold includes beveled surfaces for molding the beveled surfaces 198 of the support block 192 as well as a bottom surface for molding a bottom surface 200 of the support block 192. The mold beveled and bottom surface dimples are angled approximately 45°.

When the support block 192 is cured and removed from the mold, the dimples in the mold will have formed protrusions 197 on side, beveled, and bottom surfaces of the support block at approximately 45° angle to a top surface of the support block. The support block 192 is mounted in a sponge block cavity 202 by pressing the support block 192 into the sponge block cavity until it bottoms out. Insertion is easy because protrusions on side and beveled surfaces of the support block 192 are angled upwardly. Because the sponge block cavity 202 is approximately the same size as an outer surface of the support block 192, and because the sponge block 194 has elastic rebounding properties, it will compress to the support block during insertion creating a mechanical bond as the support block protrusions enter pores of the sponge block 194 making it virtually impossible to directly remove the support block 192 from the sponge block 194. This second alternate embodiment manufacturing process eliminates the adhesive step. A value of this method is that when a sponge block 194 wears out it may be cut or peeled from the support block 192 and a new sponge block may be easily attached. A disadvantage of this method is that it does not allow the creating of a dimple in a bottom surface 204 of the sponge block 194.

It will be appreciated by those of ordinary skill in the art that the transition portions of the support-block sidewall surfaces, inwardly beveled toward the substantially flat bottom, allow sponge bottom outer surfaces to be smoothly rotated between a horizontal surface being cleaned, such as a bottom of a tub, and a vertical surface, such as a side of a tub. Such rotation is accomplished without unduly cutting or damaging the sponge block thereof while maintaining a firm cleaning contact of the tub. Thus, this beveled transition portion provides a smoother transition of movement of the cleaning device through contours and corners in vertical rotation. Deeper beveled transition portions of the fifth embodiment of FIGS. 15–17 improve vertical rotation even more, but do not provide as much support for the sponge block. Similarly, beveled corners of the support block, like the short corner sides **94*b* of the third embodiment of FIG. 10, aid in horizontal rotation for moving from cleaning one vertical wall to cleaning another vertical wall, at a corner for example. For these reasons, the FIG. 10** embodiment is perhaps the most versatile of all the described embodiments since it includes both transition portions inwardly beveled toward the substantially flat bottom and beveled corners.

Further, by spacing the bottom edge area of the sponge outer surface a greater distance from the support-block outer surface than are other portions of the sponge outer surface, the bottom edge area can easily conform to grooves and corners for efficiently cleaning them.

Still, further, by providing a support block with smooth solid sidewall and bottom surfaces, the sponge block is adequately supported to provide a cleaning device which efficiently cleans and which is extremely durable. Also, inclusion of a dimple in the sponge bottom outer surface reduces surface contact of the sponge bottom surface with a surface being cleaned under normal cleaning conditions. Such reduction in contact facilitates easy movement of the device on an area being cleaned for light cleaning and rinsing. When the surface requires heavier cleaning, more pressure via the handle will cause the dimple surface to also engage the surface being cleaned.

One can modify the cleaning device of this invention while still remaining within the scope of the invention to effectively clean tubs, whirlpool baths, fiberglass hot tubs, public baths, public showers, jetted tubs, spas, swimming pools, water slides, wading pools, vats, and household and commercial containers.

With regard to beveling sidewall vertical edges and sidewall transition portions of support-block sidewalls, it is possible to bevel only some edges and portions, preferably those which are most often brought to bear for cleaning.

The support block can be made of wood or molded of a resinous plastic.

The embodiments of the invention in which an exclusive property or privilege are claimed or defined as follows:

1. A cleaning device comprising:

a rigid support block having a support-block outer surface including a support-block bottom surface and a support-block sidewall surface, said support-block bottom surface being substantially flat and said support-block sidewall surface extending upwardly from said support-block bottom surface when said support-block bottom surface is horizontal but including a substantial transition portion adjacent said support-block bottom surface which is substantially beveled inwardly toward said support-block bottom surface;

a sponge block having a sponge outer surface including a sponge sidewall outer surface and a sponge-bottom outer surface, said sponge sidewall outer surface extending upwardly from said sponge bottom outer surface when said sponge bottom outer surface is horizontal and these two surfaces intersecting at a bottom edge area, said sponge block being constructed of a sponge-like material having a cavity formed in said top outer surface thereof and extending a substantial distance into said sponge block, said cavity having a cavity surface with a cavity sidewall surface and a cavity bottom surface, said cavity surface having a size and shape that is close to the size and shape of the support-block outer surface for receiving said support block in said cavity;

a means for attaching the cavity sidewall and bottom surfaces to said support-block sidewall and bottom surfaces;

an elongated handle attached at the said top surface of said support block;

wherein said sponge bottom outer surface is substantially flat and is approximately parallel to said support-block bottom surface and wherein the bottom edge area of said sponge outer surface is spaced a distance from said support-block outer surface which is greater than distances other portions of said sponge outer surface are spaced from said support block outer surface.

2. A cleaning device as in claim 1 wherein an indented dimple is formed in said sponge bottom outer surface.

3. A cleaning device as in claim 2 wherein most of said outer surface of said sponge block is spaced within a range of from one-half inch to two inches from said outer surface of said support block.

4. A cleaning device as in claim 3 wherein the bottom edge area is spaced more than one and one-half inches from the support block at positions of greatest spacing while most other portions are spaced approximately between one half and one and one-half inches.

5. A cleaning device as in claim 2 wherein said cavity is formed to have a concaved cavity bottom surface prior to being adhered to said rigid support block.

6. A cleaning device as in claim 1 wherein said support block sidewall surface is substantially parallel to said sponge sidewall outer surface.

7. A cleaning device comprising:

a rigid support block having a support block outer surface including a support-block bottom surface and a support-block sidewall surface, said support-block bottom surface being substantially flat;

a sponge block having a sponge outer surface including a sponge sidewall outer surface and a sponge bottom outer surface said sponge sidewall outer surface extending upwardly from said sponge bottom outer surface when said sponge bottom outer surface is horizontal and these two surfaces intersecting at a bottom edge area, said sponge block being constructed of a sponge-like material having a cavity formed in said top outer surface thereof and extending a substantial distance into said sponge block, said cavity having a cavity surface with a cavity sidewall surface and a cavity bottom surface, said cavity surface having a size and shape that is close to the size and shape of the support-block bottom and sidewall surfaces, said support block being inserted into said cavity;

an attaching means for attaching the cavity sidewall and bottom surfaces to said support-block sidewall and bottom surfaces;

an elongated handle attached at said top surface of said support block;

wherein said sponge bottom outer surface includes an indented dimple therein.

8. A cleaning device as in claim 7 wherein said cavity is formed to have a concaved cavity bottom surface prior to said attaching means attaching the cavity sidewall and bottom surfaces to said support-block sidewall and bottom surfaces.

9. A method of constructing a cleaning device comprising the steps of:

forming a rigid support block having an outer surface including a support-block bottom surface and a support-block sidewall surface, said support-block bottom surface being substantially flat;

forming a sponge block having a sponge outer surface including a sponge sidewall outer surface and a sponge bottom outer surface, said sponge sidewall outer surface extending upwardly from said sponge bottom outer surface when said sponge bottom outer surface is horizontal and these two surfaces intersecting at a bottom edge area, said sponge block being constructed of a sponge-like material having a cavity formed in a top outer surface thereof and extending a substantial distance into said sponge block, the cavity having a cavity surface with a cavity sidewall surface and a cavity bottom surface having a size and shape which is close to the size and shape of the support-block bottom surface and sidewall surface but having a concave cavity bottom;

inserting said support block into said cavity;

adhering the cavity sidewall and bottom surfaces to said support-block sidewall and bottom surfaces whereby an indented dimple is created in the sponge bottom outer surface adjacent said cavity bottom surface.

10. A method of constructing a cleaning device comprising the steps of:

forming a sponge block having a sponge outer surface including a sponge sidewall outer surface, a sponge bottom outer surface, and a sponge top surface, said sponge top surface being formed to have a sponge block cavity therein;

inserting an elongated handle into said sponge-block cavity;

introducing fluid hardening compound into said sponge-block cavity and allowing said compound to harden thereby forming a rigid support block in said sponge block cavity which is attached to said sponge block and to said handle.

11. A method of constructing a cleaning device comprising the steps of:

forming a rigid support block having an outer surface including a support-block bottom surface and a support-block sidewall surface;

forming a sponge block having a sponge outer surface including a sponge sidewall outer surface and a sponge bottom outer surface, said sponge block being constructed of a sponge-like material having a cavity formed in a top outer surface thereof and extending a substantial distance into said sponge block, the cavity having a cavity surface with a cavity sidewall surface and a cavity bottom surface, said cavity surface having a size and shape which is close to the size and shape of the support block bottom surface and sidewall surface;

wherein the step of forming said rigid support block includes the substep of forming protrusions on the support block outer surface which allow said support block to be inserted into said sponge-block cavity but which engage said cavity surface so as to make difficult removal of said rigid support block from said sponge block cavity.

* * * * *